United States Patent [19]

Driard et al.

[11] 4,346,326

[45] Aug. 24, 1982

[54] RADIOLOGICAL IMAGE INTENSIFIER TUBE AND RADIOLOGICAL CHAIN INCORPORATING SUCH A TUBE

[75] Inventors: Bertrand Driard; Jean Ricodeau; Henri Rougeot, all of Paris, France

[73] Assignee: Thomson-CSF, Paris, France

[21] Appl. No.: 106,487

[22] Filed: Dec. 26, 1979

[30] Foreign Application Priority Data

Dec. 29, 1978 [FR] France ..... 78 36957

[51] Int. Cl.[3] ..... H01J 31/00

[52] U.S. Cl. ..... 313/388; 250/213 VT; 313/101; 313/376; 313/380

[58] Field of Search ..... 313/388, 376, 380, 367, 313/101, 102; 250/213 VT

[56] References Cited

U.S. PATENT DOCUMENTS 2,544,754 3/1951 Townes ..... 313/376

3,663,821 5/1972 Finkle ..... 313/388 X

FOREIGN PATENT DOCUMENTS 963064 2/1975 Canada ..... 313/376

*Primary Examiner*—Stanley T. Krawczewicz

*Attorney, Agent, or Firm*—Roland Plottel

[57] ABSTRACT

The invention relates to a radiological image intensifier tube with a video output. The tube has in the same vacuum envelope an image section and an analysis section having a common face occupied by target. An electrical image corresponding to the incident X-ray image is formed in the image section and this image is read in the analysis section by an electron beam scanning the target point by point. This target has in the tubes according to the invention a structure making it possible to limit the X photon-video signal gain and to regulate it between two predetermined values. On its face which receives the photoelectrons $e^-$ it has a metal barrier layer 1 covering a luminescent layer 2, in contact with a semitransparent layer 3 covering the actual target 4.

3 Claims, 4 Drawing Figures

RADIOLOGICAL IMAGE INTENSIFIER TUBE AND RADIOLOGICAL CHAIN INCORPORATING SUCH A TUBE

BACKGROUND OF THE INVENTION

The invention relates to an X-ray image intensifier tube and the radiological chain having such an intensifier.

In X-ray image intensifier tubes (IIR tubes) the incident X-rays are converted into light in a luminous screen, then into photoelectrons in a photocathode. These photoelectrons are accelerated by an electronic optics and focussed onto a luminous powder giving a luminous image of the density incident X-photon flux. For television usage this output image is taken up by an optics which re-forms the image on the photosensitive target of a camera tube, for example a Vidicon, where it creates a distribution of charges which are read by an electron beam, thus giving the video signal.

It is desirable to eliminate the IIR-Vidicon coupling optics due to its weight and overall dimensions, as well as its lack of luminosity and in general terms the additional faults which it introduces into the chain.

A first prior art solution involved IIR-Vidicon coupling by optical fibres. The luminous output screen of the IIR is brought into contact with a flat coil of optical fibres, as is the camera tube target, the two flat coils then being coupled together.

However, optical fibres have defects, which are of a serious nature when used radiologically. A defect in one of the individual fibres forming the flat coil system leads to a black zone or point and in addition the design of the fibre mosaic appears on the image.

A second prior art solution consists of eliminating the output screen of the intensifier and the optical coupling and transmitting the photoelectrons directly to a Vidicon target which is sensitive to the impact of the electrons, the system being placed in the same enclosure, such as a diode mosaic target. In this way a very high video signal—X-ray gain is obtained.

Unfortunately it is necessary to reduce to a maximum the quantumnoise of the rays by the use of very high X-doses. Moreover the dimensions of the input field of the intensifier impose high voltages on the electronic optics, which gives a high energy to the photoelectrons arriving at the target and consequently a very high electron gain in the target. Due to the high X dose and the high target gain it is necessary for the purpose of avoiding electrical saturation of the latter to provide arrangements for reducing the target gain. In such tubes it is also necessary to provide for the possibility of a target gain varying, e.g. between 1 and 50 to permit operation either in graphics or in scopics, depending on usage.

According to another prior art solution in this direction one or more thick metal barrier layers, e.g. 1 $\mu$m thick aluminium, absorbing part of the energy of the electrons is deposited on a diode mosaic target on the photoelectron arrival side introduces a considerable multiplication noise due to the fact that the energy loss of the photoelectrons in the barrier layer is a statistical phenomenon having considerable fluctuations.

BRIEF SUMMARY OF THE INVENTION

The problem of the invention is to eliminate these disadvantages and this problem is solved by the features of the claims.

BRIEF DESCRIPTION OF THE DRAWINGS

The invention is described in greater detail hereinafter relative to non-limitative embodiments and the attached drawings.

DETAILED DESCRIPTION OF THE PREFERRED EMBODIMENTS

The radiological image intensifier tube with a video output according to the invention has in the same envelope maintained under vacuum a luminous input screen in contact with a photocathode, which converts the X-rays into photoelectrons as in a known image intensifier. These photoelectrons are focussed by an electronic optics and accelerated towards a luminous powder layer, after traversing a metal layer which makes them loose part of their energy. This luminous layer is, according to the invention, deposited on the rear face of a photosensitive target previously covered with a semi-transparent layer. The luminous photons transmitted by the luminous layer and not absorbed in the semi-transparent layer create carriers in the target, which at the scanned face of the target create a distribution of charges which is read by the electron beam. All the signals read constitute the video signal.

Figure 1:
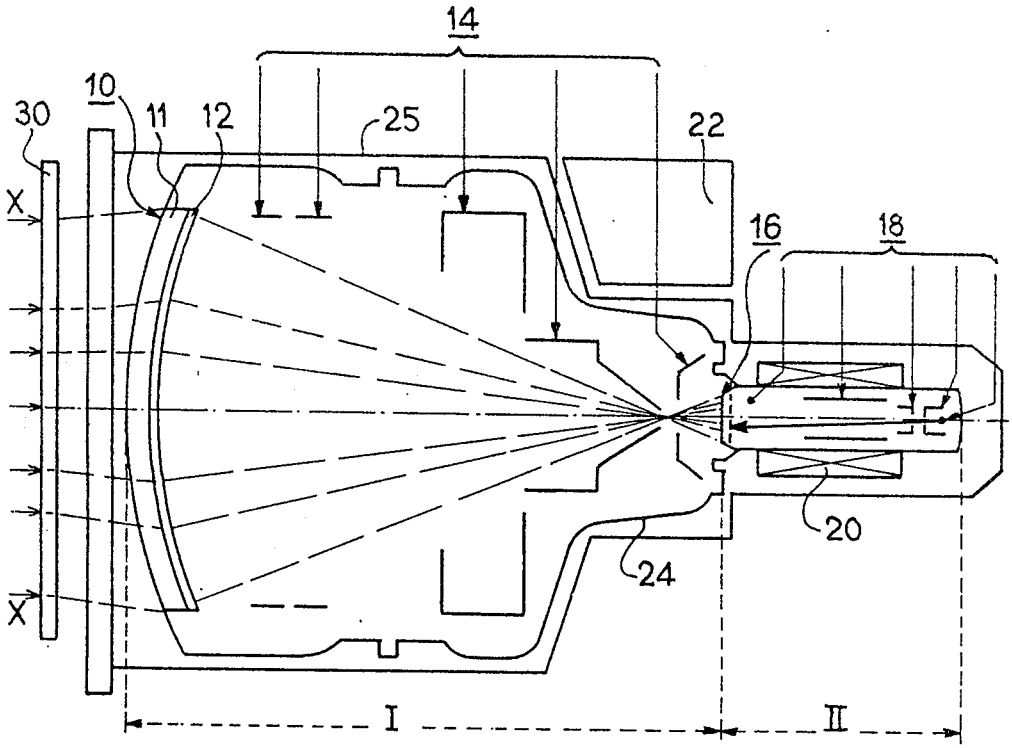
FIG. 1 a diagrammatic overall view of a radiological image intensifier tube according to the invention.
Figure 2:
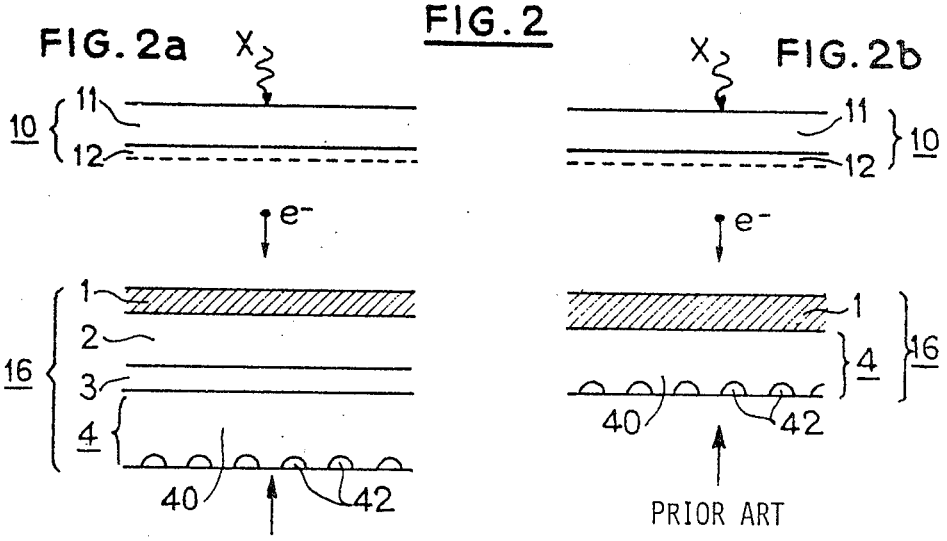
FIGS. 2*a* and 2*b* compared diagrammatic sectional views of radiological image intensifier tube targets according to the invention and the prior art respectively.

FIG. 1 shows in diagrammatic section such a tube and FIG. 2 the structure of its target compared with that of a prior art target.

The tube of FIG. 1 has two sections I and II, namely the image and analysis sections respectively. In the first of these two sections, to the left in the drawing, are produced the photoelectrons which are directed from the input screen of the tube towards the target, constituting the input face of the second section, for example a Vidicon target. This target is scanned by an electron beam from the other end of said section, to the right in the drawing. The image section I comprises, in succession from left to right in the drawing, an input screen 10 having according to the prior art a scintillator 11 and a photocathode 12 and exposed to incident X radiation (left arrows) traversing the object to the observed 30.

In operation a beam of electrons or photoelectrons from photocathode 12 is focussed and accelerated towards the output face of this first section occupied by the target of the second section. This target carries the reference numeral 16 and the various focussing electrodes the reference numeral 14. The electron beam is represented by the right-hand broken line beam. The second section of the tube also comprises means for producing an electron beam, indicated by the arrow and means ensuring in operation the point by point scanning of the target by the same. This scanning operation uses a deviation device 20, whilst the cathode and the system of electrodes of the gun carry the reference numeral 18. The assembly of the two sections is maintained under vacuum in envelope 24. In operation the acceleration of the photoelectrons is ensured by a direct voltage source 22. Finally the assembly is placed in the protective envelope 25. The video signal is sampled from the electron beam circuit under conditions which are known in the art and not therefore shown.

FIG. 2*a* shows a diagrammatic section of the target 16 of the tube according to the invention, compared with that used in tubes according to the prior art (FIG. 2*b*) and their incorporation into the intensifier. These drawings show the input screen 10 (11, 12) exposed to incident X radiation (undulating arrow) and the target 16 of the previous drawing between which are accelerated the electrons of charges $e^-$. The target according to the invention (FIG. 2*a*) has in superimposed manner on the actual target 4 on the side opposite to that read by the electron beam (arrow from the bottom) three layers consisting respectively of a metal barrier layer 1, a luminescent screen 2 and a semi-transparent layer 3, unlike the prior art targets (FIG. 2*b*), which only have the metal layer 1 in contact with target 4.

In the latter the electrons are retarded by the barrier layer 1 in such a way as to strike the target with a sufficiently reduced energy compared with their acceleration energy to prevent the disadvantages referred to. This layer is, for example, of aluminium and has a thickness of 1 micrometer.

In the target according to the invention the electrons are retarded, as in the prior art, by a metal layer 1. This retardation leaves them sufficient energy to excite the underlying luminous layer 2, which transmits photons to the semi-transparent layer 3. The metal layer 1, which is also of aluminium for example, has in this case a smaller thickness than in the prior art and namely of the order of 5,000 Angstroms. The photons transmitted by layer 2 of the target are absorbed by the semi-transparent layer 3 in a proportion dependent on its thickness and nature. The semi-transparent material used is, for example, chromium deposited on the target 4 with a thickness of approximately 500 Angstroms. The luminous layer is formed from a cathodoluminescent material such as calcium tungstate, $Ca\ WO_4$, with a thickness of 5,000 Angstroms, or zinc sulphide, ZnS.

Thus, according to the invention, the gain reduction takes place at two levels, namely firstly by retardation, as in the prior art at the metal barrier layer 1 and then, at the semi-transparent layer 3 by photon absorption. This arrangement makes it possible to use two parameters for reducing the X-ray—video signal gain and regulate its value between the desired limits.

It also makes it possible to reduce this gain by acting on a large number of particles which, everything else being equal, reduces noise. It makes it possible to adjust the gain by acting on the accelerating voltage of the electrons.

Moreover a sufficiently high accelerating voltage makes it possible to give the photoelectrons an energy sufficient to enable them to traverse both the metal barrier layer 1, the luminous layer and the semi-transparent layer, whereby they reach the target 4 and excite it directly with a sufficiently high gain to permit observations in fluorography with a low dosage of incident X-rays. These possibilities constitute advantages of the invention compared with the prior art. The gain is broken down as follows: each incident X photon creates P photoelectrons (approximately 150 to give an idea) and each of these photoelectrons creates G photons in the luminous layer 2 of the target of the tube according to the invention, being absorbed partly by the semi-transparent layer 3 so as to only permit the passage of the fraction T. Each of these photons creates a carrier in the target 4, so that the number of free carriers in the target per incident X photon is finally TGP. This gain is reduced to the two latter factors GP in the case of a prior art target only having the barrier layer 1, accepting that each incident electron creates G carriers in the target.

The input screen 10 of the tubes according to the invention is of the type used in the art for forming radiological images, namely a two-layer screen, one layer being cesium iodide, ICs, for example with a thickness of 100 to 200 microns and the other a photoemissive material, such as potassium sodium antimonide, Sb $Na_2K$, with a thickness of approximately 500 Angstroms.

It has been assumed that the target 4, read by the electron beam, is a semiconducting target constituted by a mosaic of diodes formed in a semiconducting substrate, in the manner shown in the drawings where the diodes carry the reference numeral 42 and the substrate the reference numeral 40. Within the scope of this invention the target can be any photosensitive target read by a prior art electron beam.

Figure 3:
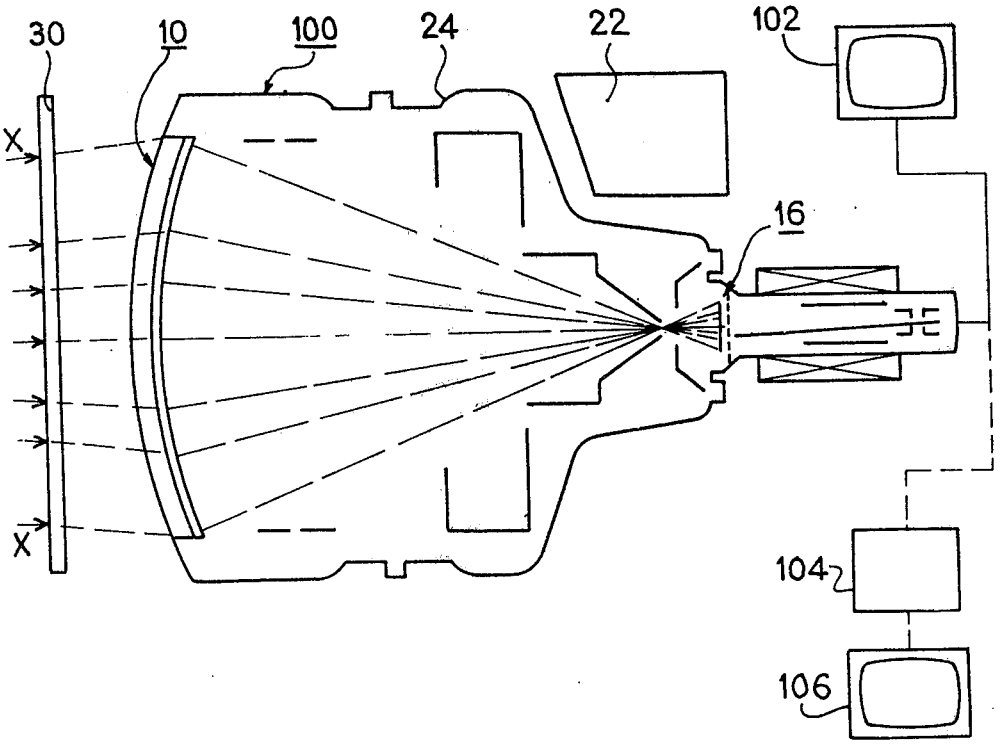
FIG. 3 a diagram of a radiological chain using an image intensifier tube according to the invention.

The tubes according to the invention are used in radiological chains, particularly in fluoroscopy, for the direct visualization on a television screen or in fluorography for visualization with a memory. The diagram of chains of this type is given in FIG. 3 where the tube assembly carries the reference numeral 100. Reference numeral 102 designates the visualization screen terminating the chain in the first case and reference numerals 104 and 106 the memory tube and visualization screen in the second case. The signals are directly sampled at the output of the tube in the scanning circuit of the target under known conditions.

The invention is not limited to the embodiments described and represented hereinbefore and various modifications can be made thereto without passing beyond the scope of the invention.

What is claimed is:

1. A radiological image intensifier tube with a video output combining in a vacuum envelope on either side of a target which is in four parts, on the one hand means transforming the incident X-ray image into a beam of photoelectrons directed towards the target and producing thereon an impact under the action of which an electrical image of the incident image is formed in the target, and on the other hand means for reading the electrical signals constituting the thus formed image, wherein on the side exposed to the photoelectrons this target has three successive layers consisting of a metal barrier covering a layer of luminescent material, the latter being in contact with a semi-transparent layer covering the actual target in which is formed the said electrical image.

2. A radiological image intensifier tube according to claim 1, wherein the actual target is a diode mosaic target formed in a semiconducting substrate.

3. A radiological chain having a radiological image intensifier tube and a screen supplied by the reading signals of this tube for the visualization of the incident image, wherein the intensifier tube is a tube according to claim 1.

* * * * *